United States Patent [19]

Del Pino

[11] Patent Number: 4,614,312

[45] Date of Patent: Sep. 30, 1986

[54] ROLL PAPER HOLDER

[76] Inventor: Herman D. Del Pino, 322 Prospect Dr., San Rafael, Calif. 94901

[21] Appl. No.: 642,398

[22] Filed: Aug. 20, 1984

[51] Int. Cl.[4] ..... B65H 16/06; B65H 19/00

[52] U.S. Cl. ..... 242/55.2; 242/55.3; 242/55.53

[58] Field of Search ..... 242/55.2, 55.3, 55.53; 312/39, 40; 206/804

[56] References Cited

U.S. PATENT DOCUMENTS

| | | | |
|---|---|---|---|
| 1,187,705 | 6/1916 | Calvert | 242/55.2 |
| 1,217,211 | 2/1917 | Pico | 242/55.2 X |
| 1,274,137 | 7/1918 | Carroll | 242/55.2 |
| 1,367,358 | 2/1921 | Davidson | 242/55.3 |
| 1,523,491 | 1/1925 | Rast | 242/55.2 |
| 1,585,051 | 5/1926 | Skoglund | 206/804 |
| 2,299,736 | 10/1942 | Cavoto | 242/55.3 |
| 2,500,514 | 3/1950 | Bozoti | 242/55.2 |
| 2,555,885 | 6/1951 | Hope | 242/55.53 |
| 2,627,382 | 2/1953 | Borton | 242/55.3 |
| 2,879,012 | 3/1959 | Sarro | 242/55.2 |
| 2,905,404 | 9/1959 | Simmons | 242/55.2 |
| 2,978,197 | 4/1961 | Anderson | 242/55.2 |
| 3,072,351 | 1/1963 | Connolley | 242/55.3 |
| 3,245,626 | 4/1966 | Casteel | 242/55.3 |
| 3,515,849 | 9/1984 | Wheeler | 242/55.2 |
| 3,589,505 | 6/1971 | Burniski | 206/804 |
| 3,729,145 | 4/1973 | Koo et al. | 242/55.53 |
| 3,878,998 | 4/1975 | Lazzari | 242/55.2 |

*Primary Examiner*—John M. Jillions

*Attorney, Agent, or Firm*—Owen, Wickersham & Erickson

[57] ABSTRACT

A roll paper holder has a pair of spaced apart spring loaded plungers having generally hemispherical portions for engaging in the ends of a roll of paper. For loading, the paper roll is simply pushed into position, causing the plungers to retract and then return into engagement with the open ends of the roll.

3 Claims, 7 Drawing Figures

ROLL PAPER HOLDER

BACKGROUND OF THE INVENTION

The invention relates to apparatus for holding a roll of paper, such as toilet paper or kitchen towel paper, and more particularly to a wallmounted device with retractable spring-loaded plungers for engaging the two ends of the roll.

Various configurations of roll paper holders have been suggested in the prior art. For example, see U.S. Pat. Nos. 515,849, 1,523,491, 2,500,514, 2,879,012, 2,905,404, 2,978,197, and 3,878,998. Springs of different forms have commonly been used on roll paper holders such as toilet paper holders. Of the above cited patents, Sarro U.S. Pat. No. 2,879,012 and Lazzari U.S. Pat. No. 3,878,998 are perhaps the most pertinent to the present invention. Both show spring-loaded paper roll engagers which yield when the paper roll is pushed in, then nest in the ends of the roll. The Sarro patent shows a somewhat crude form of spring loading provided through springable bending of a pair of metal arms, and the patent shows rounded, generally hemispherical roll end engagers. The Lazzari patent shows angled planar surfaces on spring-loaded plungers, again for nesting in the ends of the roll.

Neither of these patents combined the simplicity and effectiveness of the present invention. The Sarro device, in two different embodiments, is relatively simple but uses a less controllable form of spring, the bendable spring arms. In fact, the Sarro paper holder as disclosed relies upon manual spreading of the springable arms for insertion and removal of the roll of paper. The Lazzari paper holder, with compression coil springs engaging the plungers, was more sophisticated but required orientation of the angled-faced plungers, since rotation away from the direction the paper was to be inserted would have made the holder inoperable. Also, the plungers had relatively sharp edges which would tend to dig into the ends of the rolled paper, particularly of soft paper such as toilet paper. Further, the oriented biased surfaces of the plungers would not permit removal of the paper roll toward the same direction from which it was inserted.

None of the paper holding devices of the prior art exhibited the simplicity and efficiency of the present invention described below.

SUMMARY OF THE INVENTION

The paper roll holder of the present invention overcomes the difficulties and shortcomings of prior art apparatus by providing a simple paper holder of generally conventional configuration, mountable on a wall or recessed in a wall. The wall-mountable form of paper holder has a pair of side panels or support arms extending from a wall-mountable base, each arm containing within it a compression coil spring which bears against a retractable plunger member. Each arm has a circular opening oriented toward the position of the paper roll, and sized to retain the retractable plunger against which the spring bears, so that the plunger cannot escape from the cavity of the arm. The plunger includes a rounded, generally hemispherical roll-engaging portion extending out of the opening and into position to engage the open end of the paper roll when the roll is inserted into the holder. Each support arm may include a removable back cover on the opposite side from the hemispherical roll engager, for assembly and access to the spring.

With this relatively simple configuration, the roll paper holder of the present invention enables a roll of paper to be loaded simply by pushing it into position, causing the rounded surfaces of the plungers to retract and then engage and nest in the ends of the paper roll. The plungers apply some friction to the paper roll in use, to prevent overspinning and to assist in tearing off the paper. The roll is removed simply by pulling it out.

It is therefore among the objects to the invention to provide an improved roll paper holder for toilet paper, kitchen towel paper or other similar rolled paper products, whereby a roll of paper may be loaded simply by pushing it into position, easily accomplished with one hand. These and other objects, advantages, features and characteristics of the invention will be apparent from the following description of a preferred embodiment, considered along with the accompanying drawings.

DESCRIPTION OF PREFERRED EMBODIMENTS

Figure 1:
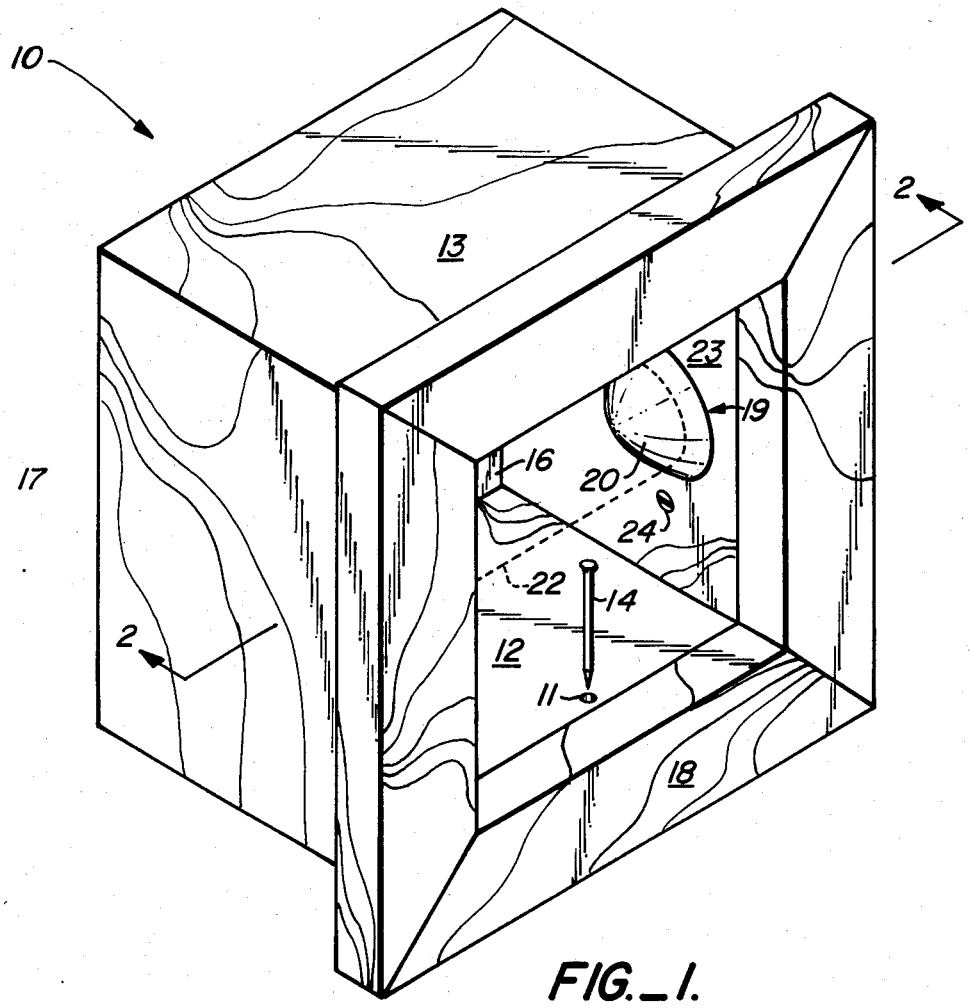
FIG. 1 is a perspective view showing a roll paper holder according to the invention, adapted for mounting in a wall recess.

In the drawings, FIG. 1 shows in perspective a paper roll holder 10 according to the invention, in an embodiment adapted for full recessing of a box-like base or housing 10*a* in a wall. Pin or nail holes 11 may be included in a bottom panel 12 and in a top panel 13 (only visible in bottom panel) for securing the paper holder 10 to internal wall structure, preferably by driving pins or nails 14 into the edge of the drywall panel of the wall, facilitating easy removal later if necessary. The top and bottom 12 and 13 of the paper holder 10 are connected to a back panel 16 and to side panels 17, and a decorative frame 18 is secured to the side, top and bottom panels. The frame 18 forms a lip for engagement against the wall, with the base or housing 10*a* fully recessed in the wall. All panels and the frame may be made of wood, or the frame 18 alone may be made of wood, with the panels formed of plastic or metal.

Each side panel 17 includes a retractable plunger 19, of which a rounded generally hemispherical roll-engaging portion 20 is visible in FIG. 1, extending through an opening in the side panel 17. The rounded ends 20 are spaced apart less than the length of a paper roll 22.

Figure 2:
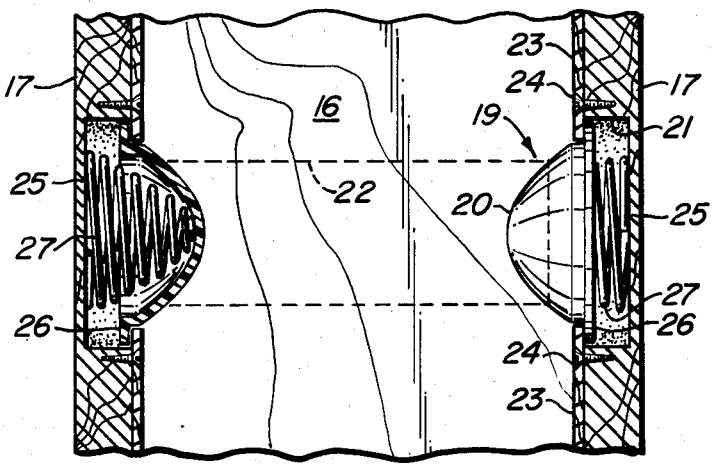
FIG. 2 is a sectional view of the paper holder of FIG. 1, showing components inside the walls of the device.

FIG. 2 shows the roll paper holder 10 in front sectional view, revealing the inner construction of the plungers within the side wall panels 17. As indicated, the wall panel preferably has a recess or bore 21 through which the plunger 19 extends to engage a paper roll core 22, as shown in dashed lines in both FIG. 1 and FIG. 2. An inner plate 23 on each panel 17, which may also be of wood and attached to the remainder of the panel 17 by screws 24 or by glue, holds back the plunger 19 from escaping the recess 21, by engaging an annular outer flange 26 of the integrally formed retractable plunger. A compression coil spring 27 pushes outwardly on the plunger 19, and bears against a back plate 25 of the panel 17 as indicated. It should be understood that the removable panel 23 of the wall panel 17 could be at the outer side of the wall panel, serving as the back plate, rather than the inner side as shown, so that access to the recess 21 would be from the outer side of the side wall panel rather than the inner side.

On each retractable plunger 19, the protruding rounded generally hemispherical portion 20 is integrally connected with the rest of the plunger including the annular flange 26.

Paper roll cores 22 vary somewhat in diameter, and as can be envisioned from FIGS. 1 and 2, the tapered and hemispherical-ended plungers 19 accommodate these varying diameters by variation in the distance to which the plungers protrude into the end openings of the core 22. FIG. 2 shows that at least one of the plungers is normally retracted somewhat when a roll 22 is being held. The rounded ends 20 on the plungers, along with the tapered shape and the spring-loaded construction, enable a roll of paper to be loaded simply by pushing it into position, causing the rounded surfaces of the plungers to retract and then to engage and nest in the ends of the paper roll. Similarly, the roll can be removed simply by pulling it out. Another advantageous feature of this construction is that the spring-loaded plungers apply constant pressure and a small amount of friction to the paper roll 22, so that the roll cannot spin freely when paper is being pulled off, and facilitating easier tearing of the paper.

Figure 3:
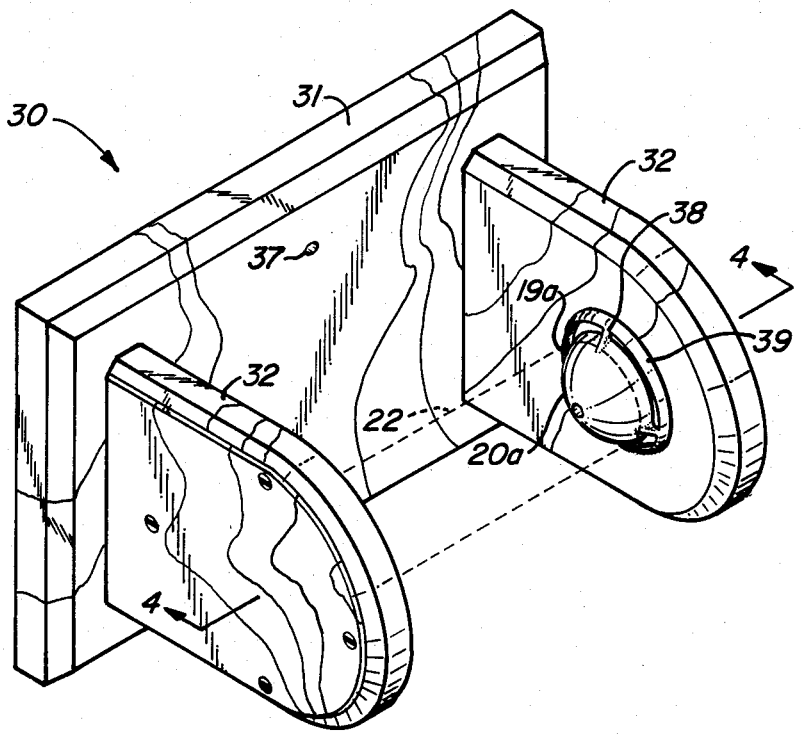
FIG. 3 is a perspective view showing another form of roll paper holder according to the invention, for surface mounting on a wall.
Figure 4:
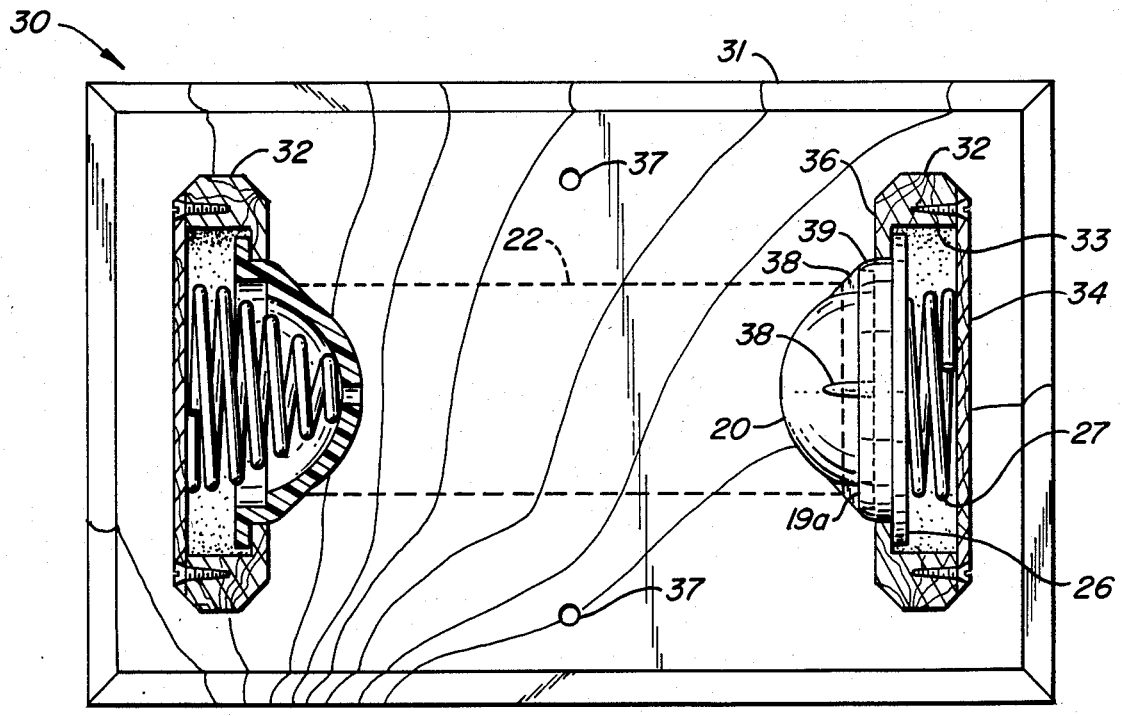
FIG. 4 is a sectional view showing the construction of the support arms of the paper holder of FIG. 3.

FIGS. 3 and 4 show a roll paper holder 30 similar in principle to the holder 10 but adapted for surface mounting on a wall, via a base 31 in the form of a wall plate. The paper holder 30 has side panels or support arms 32 connected to the base 31 and extending outwardly to support a pair of retractable plungers **19*a* similar to those shown and described above. As in the wall panels 17 of the first embodiment, the panels or arms 32 include bored-out recesses 33 for retaining the plungers 19*a* therein, again with a compression coil spring 27 urging the plunger 19*a* out of the arm. In this embodiment, an access plate 34 is shown secured to the outer side of each support arm 32, serving as a back plate for the spring, although the plate 34 could be on the inner side, with a narrowed circular bore as in the other embodiment if desired. In the form shown in FIGS. 3 and 4, the inner wall 36 of each arm 32 has an opening sized for the retractable plunger 19*a***.

In this form of the invention, screw holes 37 preferably are included in the base piece 31, for receiving screws or other fasteners for securing the paper holder to a wall.

The plungers **19*a* as shown in FIG. 3 may be of a slightly different configuration if desired. The configuration shown has a generally hemispherical protruding portion 20*a* integrally connected by connecting structure such as struts 38 to a base portion 39 which is also rounded and which includes the annular flange 26 (FIG. 4**). This configuration has been found advantageous in assuring proper seating of the plungers in the paper roll ends.

Figure 6:
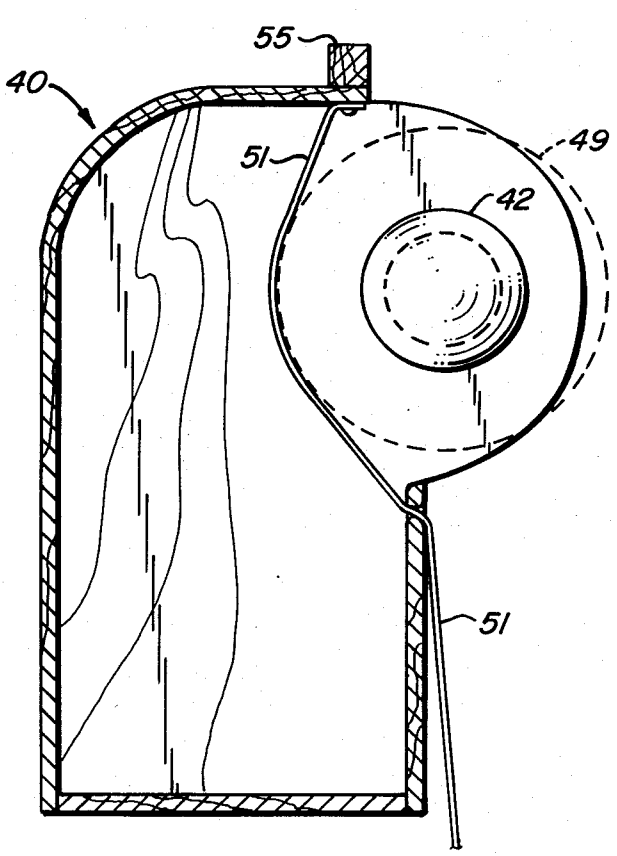
FIG. 6 is a view similar to FIG. 5, showing the spare roll after it has been pulled up into position and engaged by the plungers.
Figure 5:
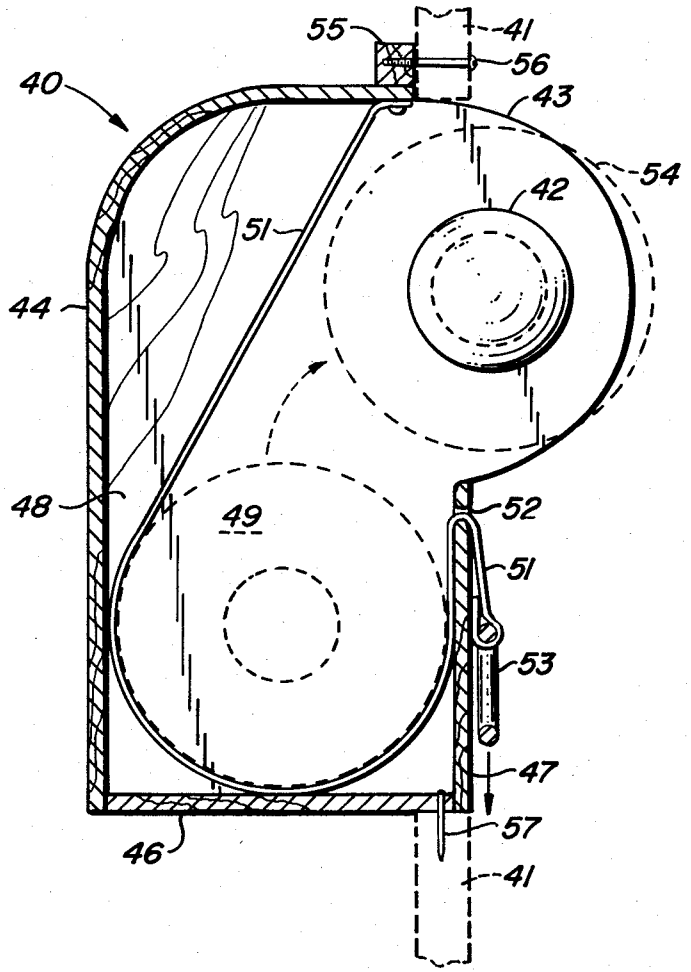
FIG. 5 is a side view in section showing a further embodiment of the invention for holding two rolls of paper including a spare roll, with indication of a means for drawing the spare roll up into position when needed.

FIGS. 5 and 6 show a further modified version of a roll paper holder 40 according to the invention, adapted for recessing in a wall 41 as indicated. In this form of paper roll holder, retractable plungers 42 again are included in side panels or support arms 43, similar internally to the construction shown in FIGS. 1 through 4 with respect to the spring-loaded plunger assemblies. The side panels 43 are connected to a back and top component 44, a bottom 46 and a front panel 47. These components form a lower compartment 48 for storing an extra roll 49 of paper around which is positioned a flat strap or ribbon 51 secured to the interior of the paper holder 40 near its top as shown, and passing through a slot-shaped opening 52 in the front panel 41 as indicated. Some form of grip, handle or ring 53 is provided at the outer end of the strap 51. When a top roll 54 of paper has been used up, its core is removed by pulling it out from between the plungers 42, and the ribbon or strap 51 is pulled down or out as indiciated in FIGS. 5 and 6 to draw the extra roll 49 up into position between the retractable plungers 42, whereupon they snap into place to engage the ends of the roll 49 and retain it in position for use. The strap opening 52 should be at a high level in the front panel 47, as near the level of the bottom of the in-use roll 54, for lifting the spare roll up into place. The opening 52 should be at least higher than the middle of the extra roll 49.

The roll paper holder 40 may have a small block or ledge 55 secured to its top as shown, for securing the unit to the wall 41 by means of a screw or other fastener 56. The bottom front may be held in place by a nail or pin 57, as illustrated.

The plungers 19, **19*a* and 42 shown in the illustrated forms of the invention may be of a plastic material having low surface friction when engaged by the cardboard paper roll 22, 49 or 54**, so that the roll will rotate freely but will be held snugly to prevent wobbling or overspinning when rotated, as occurs with typical prior art toilet paper holders. The plungers may alternately be made of wood or metal with a finished or polished surface adapted to provide low-friction engagement with the paper roll tube.

The forms of the invention described and illustrated herein are preferred embodiments representative of the invention, but are not intended to be limiting of the scope of the invention. Variations will be apparent to those skilled in the art and may be made without departing from the spirit and scope of the following claims.

I claim:

1. A roll paper holder, comprising:

a base with means for connection to a wall;

a pair of opposed side panels associated with the base, each said panel extending forwardly of the base and having an opening therein, a retractable plunger extending partially through the opening and confined against escaping therefrom and including a generally hemispherical portion, a concentric ring portion spaced radially outwardly from said hemispherical portion and angularly spaced struts connecting the hemispherical and ring portions together, so that when said hemispherical portions project from the openings they are in position to engage the ends of a paper roll, the two generally hemispherical portions being spaced apart less than the length of a paper roll to be held; and a compression coil spring in each side panel, engaging the plunger and urging it toward the opposite plunger, and a back plate on the side panel against which the spring bears;

whereby the plungers with their generally hemispherical and concentric ring portions retract into the side panels when a roll of paper is pushed between them, and then partially return to engage and hold the roll with at least the hemispherical portions extending into the open ends of the roll, and said spaced apart struts being adapted to hold paper rolls having a slightly larger diameter than standard sized rolls.

2. The roll paper holder of claim 1, wherein the retractable plunger comprises a plastic disc of circular shape, with said generally hemispherical portion having a low-friction surface for engaging against the end of the paper roll, said concentric flange portion and said struts also being plastic and integral with said hemispherical portions.

3. The roll paper holder of claim 1, wherein the base comprises a housing of rectangular shape with side panels forming sides of the housing, adapted for recessed mounting in a wall, and a front frame connected to the housing forming a lip for engagement against the wall.

* * * * *